US008493305B2

(12) United States Patent
Mamba et al.

(10) Patent No.: US 8,493,305 B2
(45) Date of Patent: Jul. 23, 2013

(54) DISPLAY DEVICE

(75) Inventors: Norio Mamba, Kawasaki (JP); Naoki Takada, Yokohama (JP); Yasuyuki Kudo, Fujisawa (JP); Tsutomu Furuhashi, Yokohama (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 806 days.

(21) Appl. No.: 12/155,951

(22) Filed: Jun. 12, 2008

(65) Prior Publication Data

US 2009/0046046 A1 Feb. 19, 2009

(30) Foreign Application Priority Data

Aug. 15, 2007 (JP) ..... 2007-211743

(51) Int. Cl.
*G09G 3/18* (2006.01)

(52) U.S. Cl.
USPC ..... 345/88; 345/102; 345/690; 345/89

(58) Field of Classification Search
USPC ..... 345/88, 102, 211, 603, 690; 382/274
See application file for complete search history.

(56) References Cited

U.S. PATENT DOCUMENTS 5,724,456 A * 3/1998 Boyack et al. ..... 382/274
7,671,901 B2 3/2010 Masuda et al.
2004/0104877 A1* 6/2004 Kitagawa ..... 345/88
2005/0105147 A1* 5/2005 Gruzdev et al. ..... 358/518
2005/0134734 A1* 6/2005 Adams et al. ..... 348/518
2006/0274026 A1* 12/2006 Kerofsky ..... 345/102
2007/0002081 A1* 1/2007 Sakata ..... 345/690
2008/0150863 A1 6/2008 Morisue et al.

FOREIGN PATENT DOCUMENTS

JP 11-065531 3/1999
JP 2006-267140 10/2006
JP 2007-047279 2/2007
JP 2008-176247 7/2008

OTHER PUBLICATIONS

Office Action in Japanese Patent Appln. No. 2007-211743, dispatched Mar. 13, 2012 (in Japanese, 3 pgs.), (English language translation, 1 pg.).

* cited by examiner

*Primary Examiner* — Sumati Lefkowitz
*Assistant Examiner* — Jose Soto Lopez
(74) *Attorney, Agent, or Firm* — Antonelli, Terry, Stout & Kraus, LLP.

(57) ABSTRACT

An image processing unit (2 in FIG. 1) discards a high gray level side of input image data (RiGiBi) in accordance with a chroma coefficient (Csc), thereby to generate a signal of lowered chroma, and it expands the signal into output image data (RoGoBo) of full scale. Besides, the image processing unit (2) generates an image adjustment parameter (Th) and performs a control so as to reduce power of backlight (6), in interlocking with the full-scale expansion.

12 Claims, 6 Drawing Sheets

FIG.7
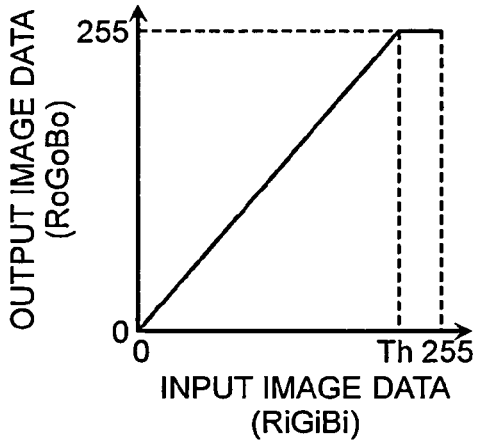
FIG.8
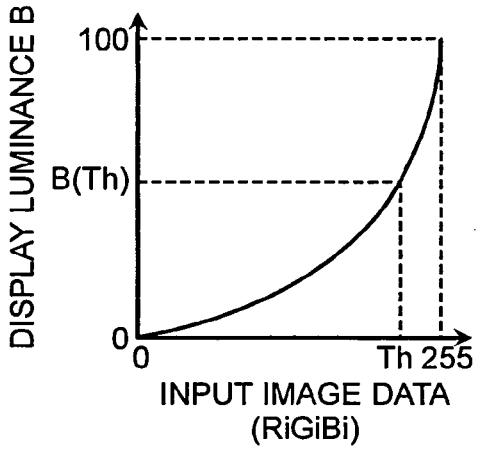
FIG.9
| GRAY LEVEL RANGE (Hsi) | GRAY LEVEL (x) | Th | BACKLIGHT LUMINANCE |
|---|---|---|---|
| Hs1 | x≧221 | 221 | 73 |
| Hs2 | 221<x≦226 | 226 | 77 |
| Hs3 | 226<x≦230 | 230 | 80 |
| Hs4 | 230<x≦235 | 235 | 84 |
| Hs5 | 235<x≦239 | 239 | 87 |
| Hs6 | 239<x≦243 | 243 | 90 |
| Hs7 | 243<x≦247 | 247 | 93 |
| Hs8 | 251<x≦255 | 255 | 100 |

DISPLAY DEVICE

CLAIM OF PRIORITY

The present application claims priority from Japanese application serial no. 2007-211743 filed on Aug. 15, 2007, the content of which is hereby incorporated by reference into this application.

BACKGROUND OF THE INVENTION

1. Field of the Invention

The present invention relates to a display device which lowers the chroma of a display image, thereby to attain the power saving of backlight.

2. Description of the Related Art

It is desired of a liquid-crystal display device to reduce the power of backlight for power saving. It is stated in JP-A-11-65531 that, in order to attain lowered power with the degradation of an image suppressed, image data are adjusted so as to raise the transmission factor of a liquid-crystal display screen, whereupon the luminance of the backlight is lowered to a corresponding degree. Concretely, using the maximum gray level or histogram of the image data, a gray level at which cumulative frequencies from the maximum gray level arrive at a fixed rate is detected by a data analysis unit, and this gray level is outputted as a threshold gray level. A backlight control unit reduces the backlight luminance to a display luminance at the detected threshold gray level. In interlocking with the backlight control unit, a data adjustment unit converts the image data whose gray levels are from "0" to the threshold gray level, into digital signals of full scale. Thus, it is intended to attain the lowered power without degrading an image of high luminance and high chroma.

In case of the image of high luminance/high chroma, however, the threshold gray level becomes high, and hence, the effect of reducing the luminance of the backlight is low. Especially in a case where the luminance of characters is high is a game screen or the like, the threshold gray level becomes high even when the luminance of the image itself is low, so that the backlight luminance cannot be reduced. Therefore, a power reduction effect based on the backlight adjustment interlocked with the image becomes low on the average, in a display device in a field where the image of high luminance/high chroma is outputted in many chances.

SUMMARY OF THE INVENTION

Therefore, the present invention has for its object to provide a display device of high luminance/high chroma in which the chroma less influencing the sense of sight is lowered, thereby to make an image degradation inconspicuous and to heighten a power reduction effect based on a backlight adjustment interlocked with an image.

The invention is characterized in that a chroma control unit for lowering the chroma of input image data is disposed in a display device. In the chroma control unit, by way of example, the image data of RGB format as the input image data are once converted into a YUV (or YCbCr) format, and only the chroma (U, V (or Cb, Cr)) being color information is lowered. Thereafter, that signal of the YUV (or YCbCr) format whose chroma has been lowered is converted into the signal of the RGB format again. Besides, the input image data of the RGB format are directly converted so as to change into a gray scale. A histogram is generated from the data processed by the chroma control unit in this manner, an image adjustment parameter is generated on the basis of the histogram, and a backlight adjustment interlocked with an image is performed by an image expansion unit and a backlight control unit.

The chroma of the input image data is lowered by the chroma control unit, whereby the maximum value in pixel units (the highest gray level data in RGB) lowers in pixels having chroma values. Thus, the maximum gray level of the image and the distribution of the histogram shifts onto a low gray level side. Since the shift becomes lower than a threshold gray level in the prior art, the effect of reducing a backlight luminance can be heightened even in an image featuring a high luminance/a high chroma. In the case of heightening the power reduction effect of backlight in this manner, the chroma which is lower in sensitivity than the luminance in the sense of sight is discarded in the invention, and hence, an image degradation lessens. Moreover, since the conversion for lowering the chroma is used in only the chroma control unit, a high precision becomes unnecessary, and the invention can be realized in a saved circuit scale.

BRIEF DESCRIPTION OF THE DRAWINGS

FIG. 7 is a graph for explaining the operation of an image expansion unit 205 shown in FIG. 2;

FIG. 8 is a graph showing the relationship between input image data and a display luminance;

FIG. 9 is a table showing a setting example of an image adjustment parameter Th and a backlight luminance;

DESCRIPTION OF THE PREFERRED EMBODIMENTS

Now, the best mode for carrying out the present invention will be described with reference to the drawings.

Embodiment 1

Figure 1:
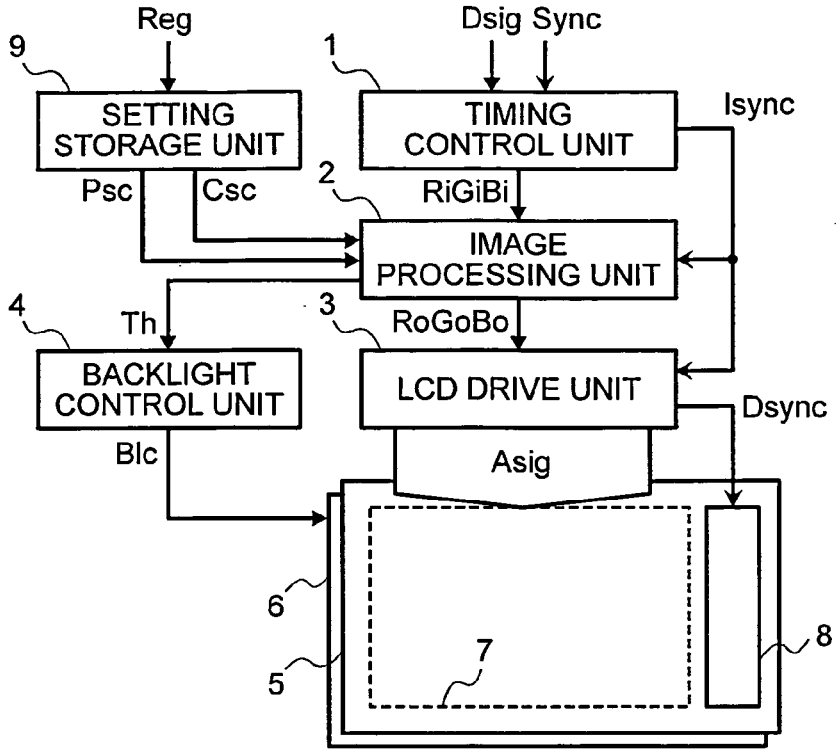
FIG. 1 is a general configurational diagram of a display device according to the present invention.

FIG. 1 is a general configurational diagram of a display device in this embodiment. Referring to FIG. 1, a timing control unit 1 generates and outputs input image data RiGiBi and an internal synchronizing signal Isync from input signals (Dsig, Sync) from an external system. Besides, a setting storage unit 9 generates and outputs a chroma coefficient Csc ($0.5 \leqq Csc < 1.0$) and a power reduction parameter Psc ($0 \leqq Psc < 1$) on the basis of setting information Reg from the external system. An image processing unit 2 outputs output image data RoGoBo and an image adjustment parameter Th on the basis of the input image data RiGiBi as well as the internal synchronizing signal Isync and the chroma coefficient Csc as well as the power reduction parameter Psc. An LCD drive unit 3 generates and outputs an analog signal Asig to be applied to a liquid crystal, and a control signal Dsync for driving a scanning circuit 8, on the basis of the output image data RoGoBo and the internal synchronizing signal Isync, whereby the analog signal is held in the display area 7 of the display panel 5. A backlight control unit 4 adjusts the luminance of backlight 6 in accordance with the image adjustment parameter Th.

In this embodiment, in the image processing unit 2, the input image data RiGiBi being an RGB signal are converted into a YUV signal, the chroma UV of the YUV signal is multiplied by the chroma coefficient Csc, and the resulting YUV signal is converted into the output image data RoGoBo being the RGB signal, again. The degree to which the chroma UV is lowered, is adjusted by the chroma coefficient Csc. Besides, the degree of power reduction is determined by the power reduction parameter Psc. Here, the letter "Y" of the YUV signal signifies a luminance signal, the letter "U" signifies the difference between the luminance signal and a blue component, and the letter "V" signifies the difference between the luminance signal and a red component.

Figure 2:
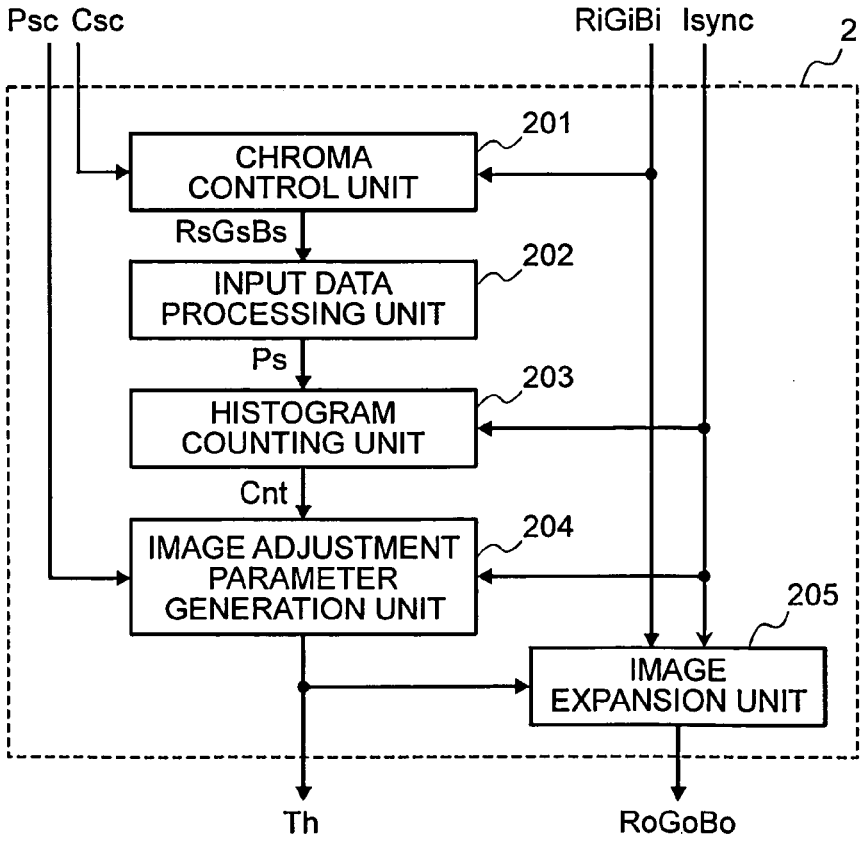
FIG. 2 is a block diagram of an image processing unit 2 shown in FIG. 1.

FIG. 2 is a block diagram of the image processing unit 2 shown in FIG. 1. Referring to FIG. 2, a chroma control unit 201 converts the input image data RiGiBi into a signal RsGsBs of lowered chroma. An input data processing unit 202, et seq. will be explained later.

Figure 3:
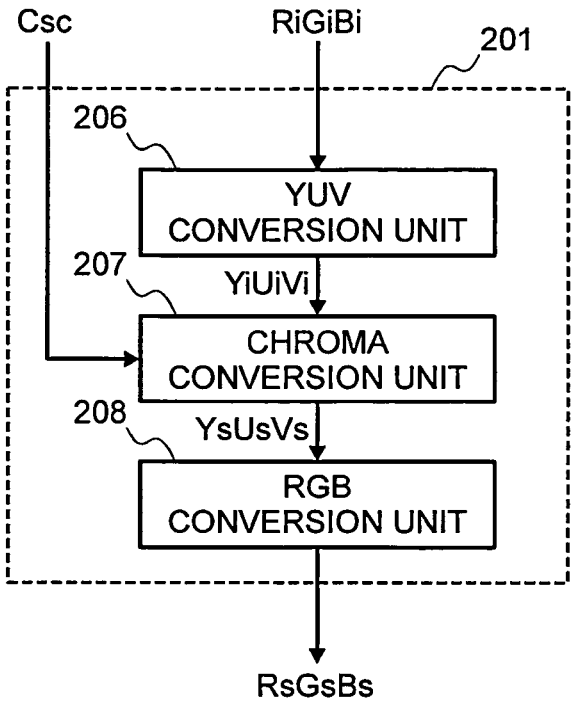
FIG. 3 is a block diagram of a chroma control unit 201 shown in FIG. 2.

FIG. 3 is a block diagram of the chroma control unit 201 shown in FIG. 2. Referring to FIG. 3, the input image data RiGiBi are converted into a YUV conversion signal YiUiVi by a YUV conversion unit 206, the YUV conversion signal YiUiVi is converted by a chroma conversion unit 207 into a signal YsUsVs whose chroma UV has been lowered in accordance with the chroma coefficient Csc, and the signal YsUsVs is converted by an RGB conversion unit 208 into a signal RsGsBs whose chroma has been lowered.

Figure 4:
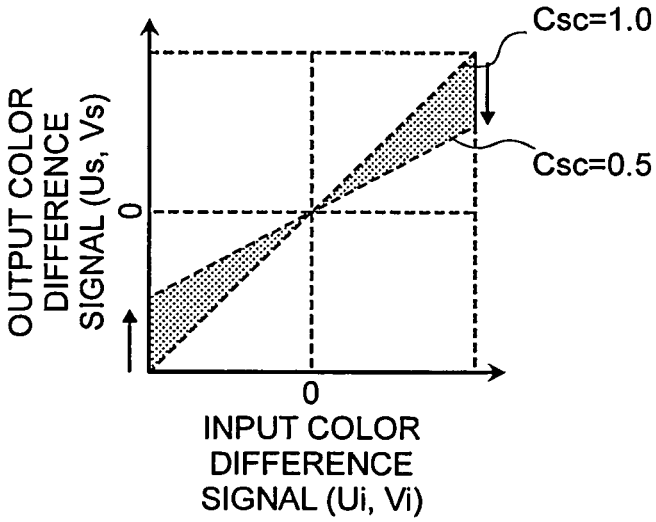
FIG. 4 is a diagram for explaining the operation of a chroma conversion unit 207 shown in FIG. 3.

FIG. 4 is a diagram for explaining the operation of the chroma conversion unit 207 shown in FIG. 3. Referring to FIG. 4, an output color difference signal (Us, Vs) is calculated by the multiplication between the chroma coefficient Csc and an input color difference signal (Ui, Vi). Incidentally, the luminance signal is not processed, and hence, Yi=Ys holds.

The YsUsVs signal of the lowered chroma is converted into the RGB signal again, whereby the maximum value of three pixels RsGsBs after the conversion becomes lower in the gray level than the maximum value of three pixels RiGiBi. However, this applies only in a case where the original pixels have chroma values.

Next, referring to FIG. 2, the input data processing unit 202 generates pixel information Ps for generating a histogram, from the signal RsGsBs of the lowered chroma. Here, the pixel information Ps will be explained as the highest gray level data among the gray level data of the three pixels RGB. However, the pixel information Ps is not limited to the highest gray level data, but the luminance Y calculated from the RGB data or all the data RGB may well be employed. Further, the pixel information Ps may well be set at a color (in general, G (green)) in which the color characteristics of high gray levels exerts more influence on the sense of sight, depending upon the color characteristic of the display panel 5.

Figure 5:
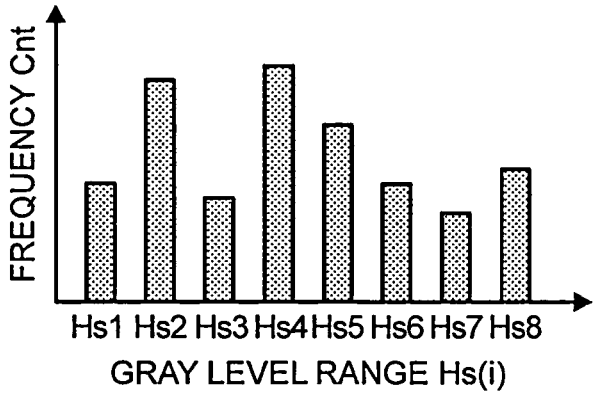
FIG. 5 shows a histogram indicating frequencies Cnt in a gray level range Hs(i)

A histogram counting unit 203 sets eight gray level ranges Hs1, Hs2, . . . , and Hs8 for the pixel information Ps as shown in FIG. 5 by way of example, and it counts pixels falling within the respective gray level ranges, so as to output frequencies Cnt which are count results of every frame. The number of the gray level ranges is not limited to eight.

An image adjustment parameter generation unit 204 generates the image adjustment parameter Th in accordance with the frequencies Cnt of the individual gray level ranges as outputted from the histogram counting unit 203, and the power reduction parameter Psc.

Figure 6:
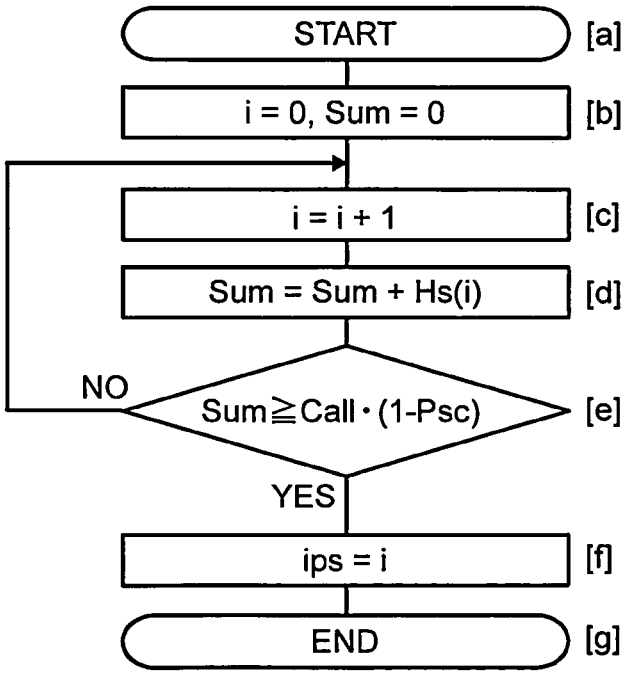
FIG. 6 is an operating flow chart of an image adjustment parameter generation unit 204 shown in FIG. 2.

A flow chart on that occasion is shown in FIG. 6. Referring to FIG. 6, the parameter generation is started at a step a, and counters "i" and "Sum" are initialized at a step b. Subsequently, the counter "i" is incremented at a step c, and the frequency Cnt of the gray level range Hs(i) as shown in FIG. 5 is cumulatively added to the counter "Sum" at a step d. The magnitude of the counter "Sum" is discriminated at a step e, and the routine returns to the step c or advances to a step f, depending upon the result of the discrimination.

At the step e, using the power reduction parameter Psc ($0 \leqq Psc < 1$), "Call" which is the summation (constant) of the frequencies Cnt of one frame is multiplied by (1−Psc). In a case where the power reduction parameter Psc=0 holds, the frequencies Cnt up to the gray level range Hs8 are counted, and any gray level data are not discarded, but a power reduction rate is zero. In a case where the power reduction parameter Psc is less than one, gray level data on a high gray level side are discarded in accordance with the value of the parameter Psc, and a power reduction effect is attained.

At the next step f, the value of the counter "i" at the step e is written into the number "ips" of a gray level region, and the parameter generation is ended at a step g.

The image adjustment parameter Th for selecting the gray level region Hs (ips) of the histogram is generated on the basis of the number "ips" of the gray level region thus obtained.

An image expansion unit 205 shown in FIG. 2 generates the output image data RoGoBo on the basis of the image adjustment parameter Th. An example of the data RoGoBo is shown in FIG. 7. Referring to FIG. 7, gray level data exceeding the image adjustment parameter Th are discarded, and the input image data of "0" to "Th" are expanded from "0" to "255" in a full scale in case of, for example, an 8-bit digital signal.

Besides, the backlight control unit 4 shown in FIG. 1 outputs a control signal Blc for controlling the luminance of the backlight 6 on the basis of the image adjustment parameter Th. The situation of the control signal output is shown in FIG. 8. Referring to FIG. 8, in a case, for example, where the display device of this embodiment has a characteristic of $\gamma=2.2$, the luminance B(Th) at the gray level Th becomes $B(Th)=Th^{2.2}/255^{2.2}*100$ where the maximum display luminance B(255) at the gray level 255 is 100.

In this embodiment, the input image data RiGiBi exceeding the image adjustment parameter Th are discarded by the image expansion unit 205, and the non-discarded input image data RiGiBi are expanded to the full scale so as to generate the output image data RoGoBo. Therefore, even when the backlight luminance is lowered to B(Th), the luminance in the display image does not change. In this way, the backlight control unit 4 outputs the control signal Blc so that the backlight luminance may become B(Th) in accordance with the image adjustment parameter Th.

As thus far described, even when the backlight luminance is lowered to B (Th), the input image data at the gray levels of "0" to "Th" are expanded to the output image data RoGoBo of the full scale at the gray levels of "0" to "255" by the image expansion unit 205, so that a display conforming to the input image data can be realized at the low power with the image degradation suppressed. Here, the power reduction parameter Psc is set so as to prevent the image degradation from appearing.

FIG. 9 is a table showing a setting example of the image adjustment parameter Th and the backlight luminance. Referring to FIG. 9, in the case where the input image data are handled with 8 bits, the ranges of gray levels (x) are stipulated in correspondence with the gray level ranges Hs1, Hs2, . . . and Hs8, and the image adjustment parameter Th is set. Besides, the relative values of the backlight luminance on that occasion are indicated.

Figure 10:
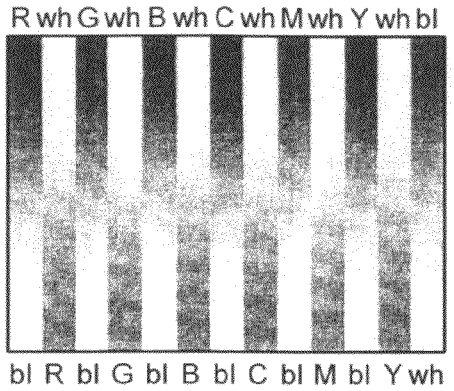
FIG. 10 is a diagram showing a display example of sample input image data.

FIG. 10 is a diagram showing a display example of sample input image data in this embodiment. Referring to FIG. 10, a horizontal direction is equally divided in 13, and gradations are displayed in a vertical direction. Here, it is assumed that the data are R(255, 0, 0), G(0, 255, 0), B(0, 0, 255), C(0, 255, 255), M(255, 0, 255), Y(255, 255, 0), wh(255, 255, 255) and b1(0, 0, 0), and that the respective data change at a rate of one gray level/one pixel. In case of the leftmost column by way of example, pixels from the uppermost one become (255, 0, 0), (254, 0, 0), (253, 0, 0), (252, 0, 0), . . . and (0, 0, 0). In the next column, pixels from the uppermost one become (255, 255, 255), (255, 254, 254), (255, 253, 253), . . . and (255, 0, 0).

Figure 11:
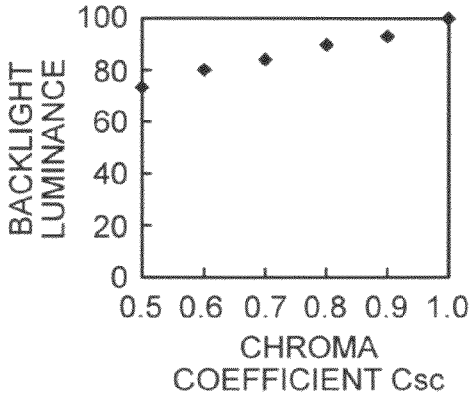
FIG. 11 is a diagram showing the relationship between a chroma coefficient Csc and the backlight luminance in the case of the sample input image data.

FIG. 11 is a diagram showing the backlight luminances in the case where the chroma coefficient Csc is changed by setting the power reduction parameter Psc at 0.3 (about 30% of the high gray level side of the histogram is discarded), for the sample input image data shown in FIG. 10. Referring to FIG. 11, a chroma coefficient Csc=1.0 corresponds to a case where the processing is not executed, and it is understood that the power lowering effect is enhanced by lowering the chroma coefficient Csc.

In this embodiment, in the case where the histogram is generated, it may well be generated except a color (in general, blue B) whose color characteristics of high gray levels do not greatly influence the sense of sight, or it may well be generated with a specified color (for example, green G) which influences sight characteristics.

Embodiment 2

Figure 12:
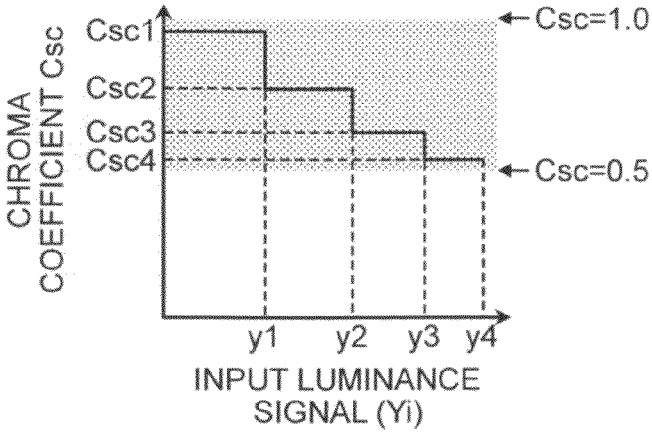
FIG. 12 is a graph showing a chroma lowering method in Embodiment 2.

This embodiment is the same as Embodiment 1 entirely in the configuration of the display device, but it differs in the chroma lowering method in the chroma conversion unit 207 shown in FIG. 3. FIG. 12 is a diagram for explaining this embodiment 2. In this embodiment, an input luminance Yi is divided into a plurality of gray level ranges, and chroma coefficients Csc are respectively set for the individual gray level ranges. By way of example, a chroma coefficient Csc1 is set for a luminance signal of or below a luminance y1, and a chroma coefficient Csc2 is set for the luminance y1 to a luminance y2. Thus, chroma values are greatly decreased in case of pixels of high luminance Yi, and they are little decreased in case of pixels of low luminance Yi, whereby the suppression of the degradation of a color and the like effects can be expected.

Embodiment 3

Figure 13:
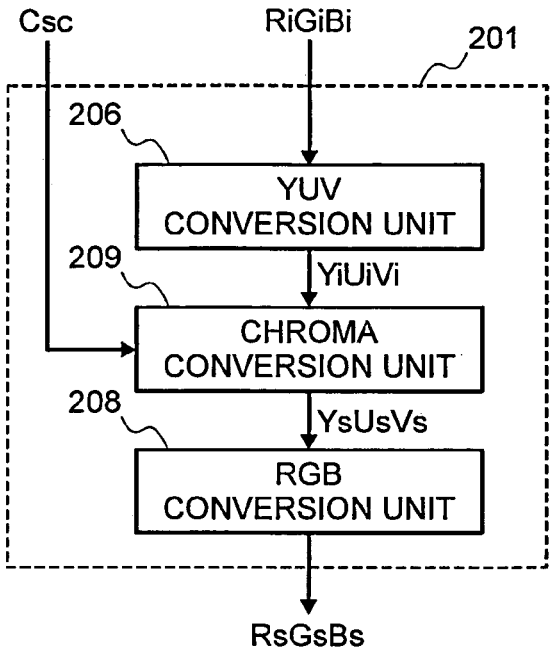
FIG. 13 is a block diagram of a chroma control unit 201 in Embodiment 3.
Figure 14:
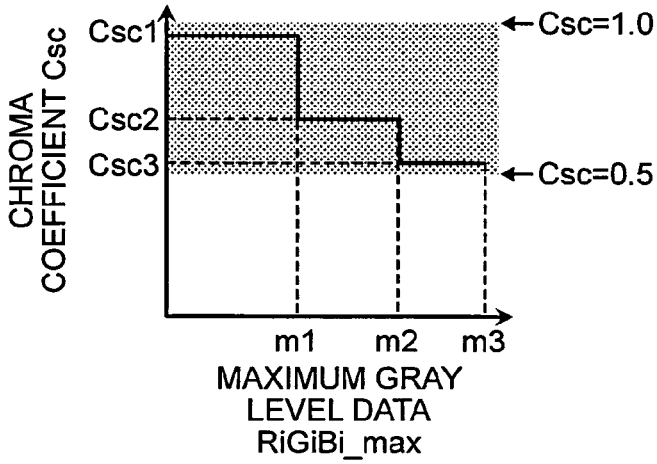
FIG. 14 is a graph showing a chroma lowering method in Embodiment 3.

In the configuration of a display device, this embodiment differs from Embodiment 1 in the configuration of a chroma conversion unit included in the chroma control unit 201, and in the chroma lowering method in the chroma conversion unit. FIG. 13 is a block diagram of the chroma control unit 201, and the chroma conversion unit 209 in the chroma control unit 201 uses the image data YiUiVi after the YUV conversion, and the input image data RiGiBi before the conversion. FIG. 14 is a diagram for explaining the processing in the chroma conversion unit 209.

In this embodiment, chroma coefficients Csc are respectively set in accordance with the maximum gray level data of the individual pixels of the input image data RiGiBi. By way of example, a chroma coefficient Csc1 is used in a case where the maximum gray level data RiGiBi_max of the individual pixels is, at most, m1, and a chroma coefficient Csc2 is used in a case where the maximum gray level data RiGiBi_max of the individual pixels is above m1 and below m2. Also in this case, as in Embodiment 2, chroma values are greatly decreased in case of pixels of high luminance, and they are little decreased in case of pixels of low luminance, whereby the suppression of the degradation of a color can be expected.

In the embodiments thus far described, the input RGB signal has been once converted into the YUV signal so as to control the chroma, by the chroma control unit 201 shown in FIG. 2. As stated in JP-A-11-65531, however, the input RGB signal may well be once converted into the YCbCr signal so as to control the chroma.

Embodiment 4

Figure 15:
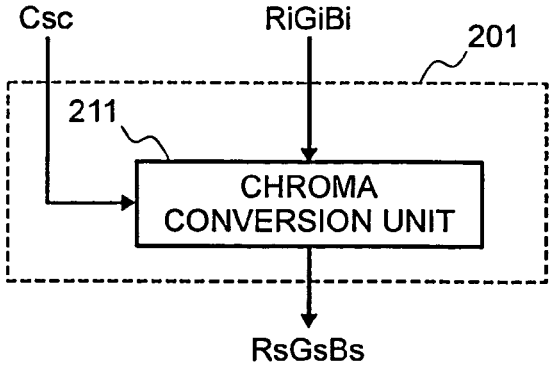
FIG. 15 is a block diagram of a chroma control unit 201 in Embodiment 4.

In this embodiment, the input RGB signal is directly converted so as to control the chroma. FIG. 15 is a configurational diagram of a chroma control unit 201 in this embodiment, and the chroma control unit 201 is configured only of a chroma conversion unit 211. The chroma conversion unit 211 converts the input image data RiGiBi into the signal RsGsBs of lowered chroma in accordance with the chroma coefficient Csc, as indicated by Formulas 1 given below. By way of example, output image data Rs has the components of input image data Gi and Bi added thereto, whereby the chroma is controlled so as to come close to a gray gradation. Output image data Gs and Bs are similarly processed. In this embodiment, the YUV conversion unit and the RGB conversion unit can be omitted, so that a circuit arrangement can be simplified.

$$Rs=Csc*Ri+(1-Csc)/2*Gi+(1-Csc)/2*Bi$$

$$Gs=(1-Csc)/2*Ri+Csc*Gi+(1-Csc)/2*Bi$$

$$Bs=(1-Csc)/2*Ri+(1-Csc)/2*Gi+Csc*Bi \qquad \text{FORMULAS 1}$$

What is claimed is:

1. A display device comprising:

an image processing unit which performs image processing of input image data, a display panel which is driven by output image data from said image processing unit, a backlight which illuminates said display panel, and a backlight control unit which controls said backlight on the basis of an image adjustment parameter from said image processing unit;

wherein said image processing unit is configured to generate the image adjustment parameter by lowering a chroma value of the input image data on the basis of a chroma coefficient which is externally set, wherein said image processing unit includes a chroma control unit is configured to: (a) receive the input image data, (b) convert the input image data into first image data comprising a first chroma value and a first luminance value, (c) generate a second chroma value by lowering the first chroma value on the basis of the chroma coefficient that is externally set, and (d) convert the second chroma value and the first luminance value into second image data, and output the second image data, and wherein said image processing unit further includes an input data processing unit which generates pixel information from the second image data output from said chroma control unit, a histogram coefficient unit which generates a histogram by counting the pixel information, an image adjustment parameter generation unit coupled to the backlight control unit, which generates the image adjustment parameter for adjusting luminance of the backlight via the backlight control unit on the basis of frequencies from said histogram coefficient unit, and an image expansion unit which discards a first part of the input image data, comprising gray level data exceeding the image adjustment parameter, by using the image adjustment parameter, and which expands a second part of the input image data, other than the first part, to full scale to generate the output image data to drive the display panel.

2. The display device as defined in claim 1, wherein said image adjustment parameter generation unit generates the image adjustment parameter on the basis of a power reduction parameter which is externally set.

3. The display device as defined in claim 1, wherein said chroma control unit includes a YUV conversion unit which converts the input image data into a YUV signal comprising a luminance signal Y and chroma UV, a chroma conversion unit which lowers the chroma UV converted by said YUV conversion unit without changing the luminance signal Y, on the basis of the chroma coefficient that is externally set, and an RGB conversion unit which converts the image data of the lowered chroma from said chroma conversion unit, into an RGB signal.

4. The display device as defined in claim 1, wherein said chroma control unit includes a YUV conversion unit which converts the input image data into a YUV signal, a chroma conversion unit which sets a chroma coefficient in accordance with maximum gray level data of the input image data and which lowers a chroma of the YUV signal, and an RGB conversion unit which converts image data of lowered chroma from said chroma conversion unit, into an RGB signal.

5. The display device as defined in claim 1, wherein said chroma control unit includes a chroma conversion unit which lowers the chroma of the input image data on the basis of the chroma coefficient that is externally set.

6. The display device as defined in claim 1, wherein the image expansion unit expands the discarded part of the input image data to full scale to generate the output image date.

7. A display device comprising:

an image processing unit which performs image processing of input image data, a display panel which is driven by output image data from said image processing unit, a backlight which illuminates said display panel, and a backlight control unit which controls said backlight on the basis of an image adjustment parameter from said image processing unit;

wherein said image processing unit includes means for generating the image adjustment parameter by lowering a chroma value of the input image data on the basis of a chroma coefficient which is externally set, and wherein said image processing unit further includes:

a chroma control means for (a) receiving the input image data, (b) converting the input image data into first image data comprising a first chroma value and a first luminance value, (c) generating a second chroma value by lowering the first chroma value on the basis of the chroma coefficient that is externally set, and (d) converting the second chroma value and the first luminance value into second image data and outputting the second image data, an input image data processing means for generating pixel information from the second image data output from said chroma control means, a histogram coefficient means for generating a histogram by counting the pixel information, an image adjustment parameter generation means coupled to the backlight control unit for generating the image adjustment parameter for adjusting luminance of the backlight via the backlight control unit on the basis of frequencies from said histogram coefficient means, and an image expansion means for discarding a first part of the input image data comprising gray level data exceeding the image adjustment parameter, by using the image adjustment parameter and for expanding a second part of the input image data other than the first part, to full scale to generate the output image data to drive the display panel.

8. The display device as defined in claim 7, wherein said image adjustment parameter generation means includes means for generating the image adjustment parameter on the basis of a power reduction parameter which is externally set.

9. The display device as defined in claim 7, wherein said chroma control means includes a YUV conversion means for converting the input image data into a YUV signal comprising a luminance signal Y and chroma UV, a chroma conversion means for lowering the chroma UV converted by said YUV conversion means, without changing the luminance signal Y, on the basis of the chroma coefficient that is externally set, and an RGB conversion means for converting the image data of the lowered chroma from said chroma conversion unit, into an RGB signal.

10. The display device as defined in claim 7, wherein said chroma control means includes a YUV conversion means for converting the image data into a YUV signal, a chroma conversion means for setting a chroma coefficient in accordance with maximum gray level date of the input image data and which lowers a chroma of the YUV signal, and an RGB conversion means for converting image data of lowered chroma from said chroma conversion means, into an RGB signal.

11. The display device as defined in claim 7, wherein said chroma control means includes a chroma conversion means for lowering the chroma of the input image data on the basis of the chroma coefficient that is externally set.

12. The display device as defined in claim 7, wherein the image expansion means expands the discarded part of the input image data to full scale to generate the output image date.

* * * * *